United States Patent [19]

Balazs

[11] Patent Number: 4,685,483

[45] Date of Patent: Aug. 11, 1987

[54] COLLAPSIBLE SUPPORT FOR FOOD SCREEN

[75] Inventor: Michael A. Balazs, Boca Raton, Fla.

[73] Assignee: Boca Raton Hotel and Club, Boca Raton, Fla.

[21] Appl. No.: 820,530

[22] Filed: Jan. 17, 1986

[51] Int. Cl.[4] ..... E04H 15/36

[52] U.S. Cl. ..... 135/102; 135/109; 211/180; 248/167; 248/460

[58] Field of Search ..... 135/102–104, 135/96, 109, 112, 95, 19.5, 116; 211/189, 195, 213, 180; 248/167, 453, 463, 150, 345, 346, 460; 47/19, 20, 21, 26–29, 31; 190/12

[56] References Cited

U.S. PATENT DOCUMENTS

| | | | |
|---|---|---|---|
| 97,259 | 11/1869 | Watson | 47/31 |
| 425,540 | 4/1890 | Forbriger | 135/102 |
| 451,946 | 5/1891 | Meyer | 135/96 |
| 526,942 | 10/1894 | Rhoads et al. | 135/102 |
| 708,049 | 9/1902 | Jordan | 135/102 |
| 785,915 | 3/1905 | Poltock | 135/112 |
| 788,351 | 4/1905 | Burrell | 135/96 |
| 809,546 | 1/1906 | Wever | 135/96 |
| 880,183 | 2/1908 | Apple | 135/112 |
| 906,024 | 12/1908 | Hodge | 135/96 |
| 976,950 | 11/1910 | Tyner | 135/111 |
| 1,277,827 | 9/1918 | Barber | 135/102 |
| 1,516,665 | 11/1924 | Blunck | 135/102 |
| 1,900,335 | 3/1933 | Del Vecchio | 135/102 |
| 2,561,889 | 7/1951 | Seidman | 135/96 |
| 2,683,507 | 7/1954 | Coven et al. | 190/12 |
| 2,790,452 | 4/1957 | Dusek | 108/50 |
| 4,170,181 | 10/1979 | Glasgow | 108/50 |

*Primary Examiner*—James R. Feyrer
*Attorney, Agent, or Firm*—Kenyon & Kenyon

[57] ABSTRACT

A collapsible frame assembly for supporting a tablecloth screen in a draped configuration over dishes on a hotel serving cart comprises a pair of elongate U-shaped base members and a pair of arcuate support members hingedly attached to the respective base members at midway points therealong. The support members are in turn hingedly attached to one another at ends opposite the ends at which the support members are attached to the base members. Each support member is rotatable through a 90° angle relative to the respective base member and through a 108° angle relative to the other support member, whereby in an open or unfolded configuration of the frame assembly portions of the support members extend perpendicularly to the base members while in a folded or storage configuration the same portions of the support members extend substantially parallel to one another and to the base members.

10 Claims, 8 Drawing Figures

COLLAPSIBLE SUPPORT FOR FOOD SCREEN

BACKGROUND OF THE INVENTION

This invention relates to a collapsible frame assembly disposable on a horizontal surface for holding a protective cover sheet such as a tablecloth at a height and in a manner to protect items such as food on the horizontal surface. More particularly, this invention relates to such a collapsible frame assembly attachable to a serving cart for supporting a protective sheet or cloth which covers a horizontal table surface of the serving cart.

The purpose of holding a tablecloth or other sheet above food on a table surface is to provide a screen to protect the food, for example, from insects. The cover sheet may also serve to facilitate the retention of heat by the food on the table surface.

An obvious method for protecting food placed on a table surface is to lay a sheet over the food. This method is clearly unsatisfactory inasmuch as the sheet is likely to come into contact with the food, thereby soiling the sheet as well as possibly distorting the appearance of the food. It is necessary, then, to provide means for holding the cover sheet away from the food on the table surface.

Support devices for providing protective shields over horizontal surfaces are known which comprise rigid dome-shaped structures. For example, U.S. Pat. No. 788,351 to Burrell discloses a rigid ribbed structure which supports a protective cover in the form of a canopy and which can be alternately raised and lowered over a table surface. Owing to its bulk, such a device is cumbersome and inconvenient.

U.S. Pat. No. 906,024 discloses two rigid frames each having four posts supporting an arcuate ribbed umbrella structure. The support posts are provided at their lower ends with clamps for mounting the frames to a table. On a table, the frames are spaced from one another to provide a support for a protective cover sheet.

Support devices have been developed which are lightweight and which can be put into storage configurations when the support devices are not being used to hold protective sheets over horizontal surfaces. U.S. Pat. No. 809.546 to Wever, for example, discloses a pair of wire brackets each provided at opposite ends with hooks or clasps for clamping the brackets to the edges of a horizontal table surface. U.S. Pat. No. 708,049 to Jordan discloses a support device comprising four wire arms each rotatably connected at one end to the other arms by a clamping element and engageable with a horizontal table surface at an opposite end. The support device of U.S. Pat. No. 708,049 is collapsible by rotating the wire arms towards each other about respective pivot axes.

U.S. Pat. No. 451,946 to Meyer discloses a pair of foldable chains of rigid straight bars hingedly connected to each other. The chains assume V-shaped configurations when placed on a table surface for holding a canopy over the table.

U.S. Pat. No. 526,942 to Rhoads et al. describes a food screen comprising a pair of cofunctioning identical collapsible support frames. The support frames are placed at opposite ends of a table and overlap one another to hold a protective sheet above and away from a food-bearing surface. Each support frame comprises a U-shaped base member and a plurality of U-shaped support members, the support members being connected at their ends to the opposite legs of the base member. The central portions of the support members are coupled to one another by a longitudinally extending brace or linking bracket, whereby the U-shaped support members may be collectively pivoted from a collapsed storage configuration to a raised operating configuration.

U.S. Pat. No. 2,683,507 to Coven et al. discloses a portable and collapsible food screen comprising a multiplicity of U-shaped ribs each rotatably connected at its opposite ends to a pair of semicircular brackets or plates. The food screen has a folded storage configuration in which the U-shaped ribs are parallel to one another and an open operational configuration in which the ribs occupy respective, angularly spaced radial planes.

An object of the present invention is to provide a simple and inexpensive collapsible frame assembly disposable in an open configuration on a horizontal surface for supporting a sheet or web in a tent-like configuration over items such as food placed on the horizontal surface.

Another object of the present invention is to provide such a collapsible frame assembly which can be mounted to or attached to serving carts of the kind used in hotels.

SUMMARY OF THE INVENTION

A collapsible frame assembly in accordance with the invention is adapted to be disposed in an open configuration on a horizontal surface for holding a cover sheet to protect items resting on the horizontal surface. The frame assembly comprises a pair of elongated substantially rigid base members adapted to rest on the horizontal surface and a pair of substantially rigid support members each of which has two ends. Each of the support members is cooperably connected at one end thereof to a respective one of the base members in a manner which permits each support member to rotate with respect to the respective base member. The support members are also cooperably connected to one another at ends opposite the ends connected to the base members so as to permit rotation between the support members. The frame assembly is collapsed from the open configuration by rotating the support members in a manner which brings the support members and the base members adjacent one another to form a folded storage configuration. The frame is opened from the folded storage configuration by rotating the support members in an opposite direction.

In accordance with another feature of the present invention, abutment means are provided on each of the base members for engaging at least one edge of the horizontal surface to prevent motion of the respective base member in a direction parallel to the horizontal surface and perpendicular to the surface edge. Such abutment means may advantageously include a pair of flanges at opposite ends of each base member for engaging opposed parallel edges of the horizontal surface.

Pursuant to another feature of the present invention, each of the base members has a pair of projections engageable with the horizontal surface for supporting the base members thereon. The projections advantageously extend parallel to a plane defined by the base members.

Pursuant to further particular features of the present invention, the base members are each in the form of a shallow U having an elongated central portion with a longitudinal axis. The flanges form a pair of legs at the opposite ends of the central portion and extend in a common direction from the central portion parallel to one another. The support projections on the base members are advantageously pins spaced from one another and disposed on the same side of the central portion as the legs or flanges. The central portion and the legs have a common width, the central portion having a pair of longitudinal edges extending parallel to the longitudinal axis and spaced from one another by the common width. The pins are spaced from each of the longitudinal edges of the central portion.

Preferably, the support members each have a straightened-S or ogive shape. Each support member has a first planar side and a second planar side parallel to and opposed to one another. The first and second hinges each connect a respective one of the support members on the first side thereof to the respective base member approximately at a midway point along the central portion of that base member. The first and second hinges are disposed to enable rotation between the respective support member and the respective base member through a 90° angle about a pivot axis oriented substantially perpendicularly to the longitudinal axis of the respective central portion. The support pins are spaced from and disposed on opposite sides of the midway point of the respective central portion. The third hinge is connected to the support members on the second planar sides thereof to enable a rotation between the support members through a 180° angle about a rotation axis substantially parallel to the pivot axes of the first and second hinges.

A collapsible frame assembly in accordance with the invention holds a protective cover sheet over food and not in contact therwith. The assembly is easy and simple to manufacture and assemble. The assembly contains but few parts each of which has a relatively simple structure. The frame assembly is easily removed from a table top or serving cart and folded into a collapsed state which facilitates storage, e.g., on a shelf disposed below the horizontal table surface of a serving cart.

DETAILED DESCRIPTION

Figure 1:
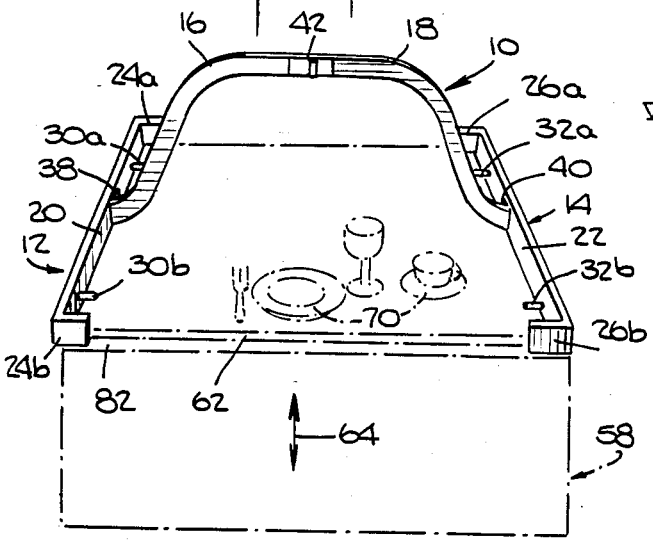
FIG. 1 is a perspective view of a collapsible frame assembly, in accordance with the present invention, in an open or unfolded configuration on a serving cart shown in dot-dash lines.
Figure 2:
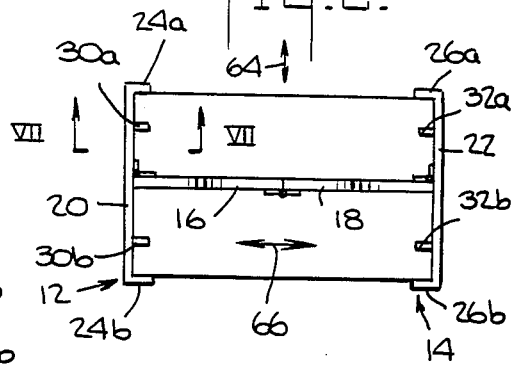
FIG. 2 is a top view, on a reduced scale, of the collapsible frame assembly illustrated in FIG. 1.

As illustrated in FIGS. 1–5, a collapsible frame assembly 10 comprises a pair of elongated substantially rigid base members 12 and 14 and a pair of arcuate support members 16 and 18. Base members 12 and 14 are each in the form of a shallow U and have respective elongated central portions 20 and 22. Base member 12 has a pair of relatively short legs or flanges **24*a* and 24*b* disposed at opposite ends of central portion 20, while base member 14 has legs or flanges 26*a* and 26*b* disposed at opposite ends of central portion 22. Flanges 24*a* and 24*b* are disposed on the same side of central portion 20, i.e., extend in a common direction therefrom parallel to one another. In a completely unfolded or opened configuration of the collapsible frame assembly 10, as illustrated in FIGS. 1 and 2, flanges 24*a* and 24*b* of the one base member 12 extend towards the other base member 14. Similarly, flanges 26*a* and 26*b* of base member 14 extend in a common direction from central portion 22 parallel to one another towards base member 12** in a completely unfolded configuration of the frame assembly.

Figure 5:
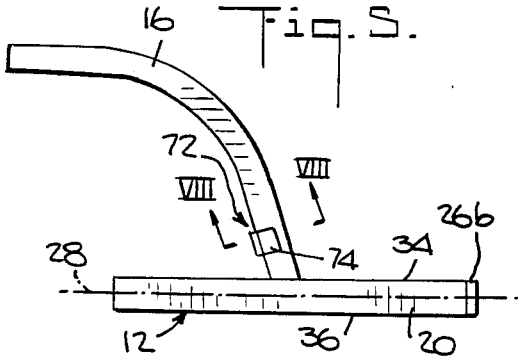
FIG. 5 is a side elevational view of the folded frame assembly illustrated in FIG. 4.

Central portions 20 and 22 of base members 12 and 14 are each symmetrical about a respective longitudinal axis, (e.g., axis 28 illustrated in FIG. 5). Base member 12 is provided with a pair of support pins **30*a* and 30*b* spaced from one another in the direction of the longitudinal axis of central portion 20 and disposed on the same side of central portion 20 as flanges 24*a* and 24*b*. Support pins 30*a* and 30*b*, as well as flanges 24*a* and 24*b*, are oriented perpendicularly to a plane defined by central body 20. Base member 14 is likewise provided with a pair of support pins 32*a* and 32*b* spaced from one another in the longitudinal direction of the respective central portion 22. Pins 32*a* and 32*b* are parallel to one another and to flanges 26*a* and 26*b***.

Figure 7:
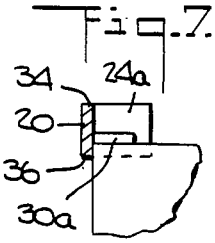
FIG. 7 is a partial cross-sectional view taken along line VII—VII in FIG. 2.

As illustrated in FIGS. 1, 5 and 7, flanges **24*a*, 24*b* and 26*a*, 26*b* and central portions 20 and 22 all have the same width. Central portion 20 has a pair of longitudinal edges or sides 34 and 36 spaced from one another by the common width. Pins 30*a* and 30*b* are each spaced in a transverse direction from both longitudinal edges 34 and 36 (see FIG. 7). Pins 32*a* and 32*b* are likewise spaced in a transverse direction from each of a pair of longitudinal edges of central portion 22**.

Each of the support members 16 and 18 is substantially in the form of an ogive, i.e., in the form of a slightly straightened S. Support member 16 is connected at a first end and on a first side to central portion 20 of base member 12 by means of a first hinge 38. Similarly, support member 18 is connected at a first end and on a first side to central portion 22 of base member 14 by means of a second hinge 40. On a second side and at a second end, support member 16 is rotatably connected to support member 18 by means of a third hinge 42. Hinge 42 is likewise connected to support member 18 at an end and on a side thereof opposite the end and side at which support member 18 is rotatably coupled to base member 14.

Figure 4:
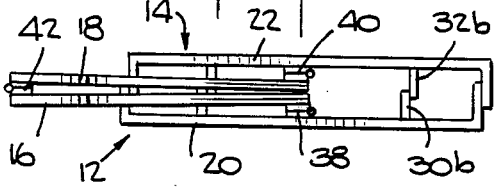
FIG. 4 is a top view, on a reduced scale, of the collapsible frame assembly of FIGS. 1–3 in a totally folded configuration.
Figure 3:
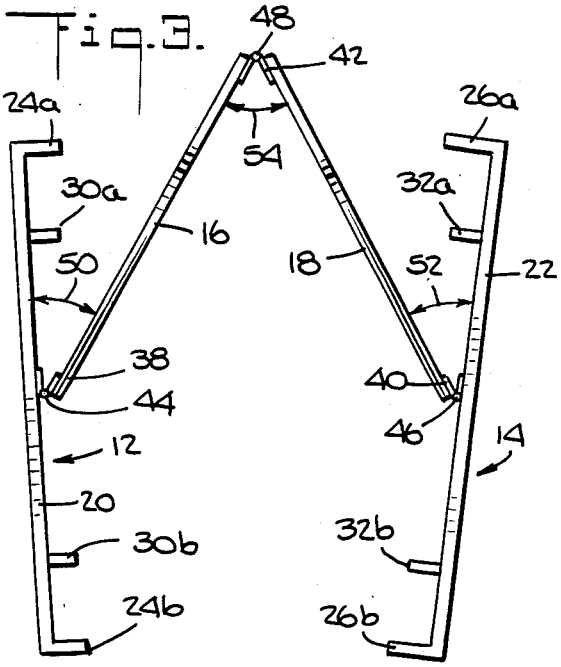
FIG. 3 is a top view, on an enlarged scale, of the collapsible frame assembly of FIGS. 1 and 2, in a partially folded configuration.

Base members 12 and 14 define a plane insofar as, for example, their lower longitudinal edges or sides (e.g., edge 36 of central portion 20) are always located in the same plane. Hinges 38, 40 and 42 have pivot pins 44, 46 and 48 (see FIG. 3) which define respective pivot or rotation axes oriented parallel to one another and perpendicularly to the plane defined by base members 12 and 14. Support member 16 and base member 12 are rotatable relative to one another about pivot pin 44, as indicated by a double-headed arrow 50 in FIG. 3, through a 90° angle from a completely open or unfolded configuration illustrated in FIGS. 1 and 2 to a completely folded or collapsed configuration illustrated in FIGS. 4 and 5. As indicated in FIG. 3 by double-headed arrow 52, support member 18 and base member 14 are rotatable relative to one another about pivot pin 46 through a 90° angle from the totally unfolded configuration of the frame assembly (FIGS. 1 and 2) to the totally folded storage configuration (FIGS. 4 and 5). As indicated by a double-headed arrow 54, support members 16 and 18 are rotatable relative to one another about pivot pin 48 through a 180° angle between the open and folded configurations of the frame assembly.

Hinges 38 and 40 are preferably fastened to central portions 20 and 22 at approximately the longitudinal midpoints thereof. However, with some materials, it may be advantageous to slightly stagger the points of attachment of hinges 38 and 40 to central portions 20 and 22 to facilitate the overlapping of legs or flanges 24*a* and 24*b* with legs or flanges 26*a* and 26*b* and the overlapping of support pins 30*a* and 30*b* with support pins 32*a* and 32*b* in the folded storage configuration of the frame assembly 10, as illustrated in FIGS. 4 and 5. Pins 30*a* and 30*b* are preferably equispaced from hinge 38 on opposite sides thereof, while pins 32*a* and 32*b* are equispaced from hinge 40 on opposite sides thereof.

In the totally open configuration shown in FIGS. 1 and 2, frame assembly 10 is supported on a horizontal table surface 56 of a serving cart 58 by means of pins or projections 30*a*, 30*b* and 32*a*, 32*b*. Because pins 30*a*, 30*b* and 32*a*, and 32*b* are spaced from the lower longitudinal edges or sides (e.g., edge 36) of the respective central portions 20 and 22, base members 12 and 14 are partially disposed below the level of table surface 56 when the frame assembly 10 is mounted on serving cart 58.

Advantageously, the distance between legs or flanges 24*a* and 24*b* and between legs or flanges 26*a* and 26*b* is approximately equal to, but slightly greater than, the respective width of the table surface 56 so that flanges 24*a* and 26*a* and flanges 24*b* and 26*b* are engageable with edges or side surfaces 60 and 62, respectively, of the table surface 56 to prevent motion of frame assembly 10 with respect to serving cart 58 in a direction indicated by a double-headed arrow 64 in FIGS. 1 and 2. Motion of frame assembly 10 with respect to serving cart 58 in another, orthogonal, direction indicated by a double headed arrow 66 is prevented by the engagement of central portions 20 and 22 with serving cart 58 along longitudinal strips of central portions 20 and 22 defined on an upper side by support pins 30*a*, 30*b* and 32*a*, 32*b* and on a lower side by the lower longitudinal edges (e.g , edge 36) of the central portions (see FIG. 7).

Pivot pins 44 and 46 of hinges 38 and 40 extend in a transverse direction at the respective central portions 20 and 22 between imaginary longitudinal lines defined by support pins 30*a*, 30*b* and 32*a*, 32*b* and the upper longitudinal edges (e.g., edge 34) of the central portions. Accordingly, the widths of hinges 38 and 40 and of support members 16 and 18 are less than the common width of support members 12 and 14.

Figure 6:
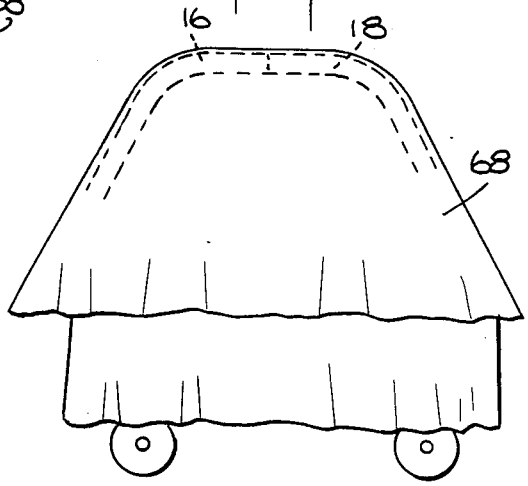
FIG. 6 is a perspective view of a serving cart having a tablecloth screen draped over a collapsible frame assembly in accordance with the invention, positioned on a horizontal upper surface of the serving cart.

In the open or unfolded configuration of frame assembly 10 illustrated in FIGS. 1 and 2, support members 16 and 18 together take a flattened bell-shaped form. As illustrated in FIG. 6, a tablecloth or other sheet 68 is draped over support members 16 and 18 provide a protective screen for food on dishes 70 (FIG. 1) placed on table surface 56 of serving cart 58.

Figure 8:
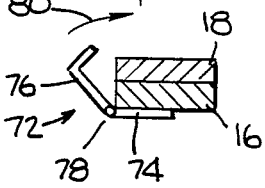
FIG. 8 is a cross-sectional view taken along line VIII—VIII in FIG. 5.

As illustrated in FIGS. 5 and 8, frame assembly 10 may be provided with a locking device in the form of a hinge 72. Hinge 72 has a planar first hinge plate 74 rigidly connected to support member 16 and an L-shaped second hinge plate 76 pivotally attached at a pivot pin 78 to hinge plate 74. Upon the removal of frame assembly 10 from table surface 56 and the folding of the frame assembly into the storage configuration shown in FIGS. 4 and 5, hinge plate 76 is rotated from an open position in the direction of an arrow 80 (FIG. 8) about pivot pin 78 to a locking or latching position shown in FIG. 5.

As illustrated in FIG. 1, serving cart 58 may be formed with a lip or ledge 82 on each side of horizontal table surface 56. In this case, base members 12 and 14 may engage and rest upon ledges 82, provided that the vertical distance between table top 56 and ledges 82 is less than or equal to the distance between pins 30*a*, 30*b* and 32*a*, 32*b* and the lower longitudinal edges or surfaces (e.g., edge 36) of central portions 20 and 22. Ledges 82 may be formed by placing a board, plate or other planar rectangular component on an upper surface of serving cart 58, the board or plate having a length and a width slightly smaller than the corresponding length and width of the upper serving cart surface. In this case, the board or plate advantageously has a height or depth substantially equal to the distance between support pins 30*a*, 30*b* and 32*a*, 32*b* and the respective lower sides or edges of central portions 20 and 22.

Although the invention has been described in terms of particular embodiments and applications, one of ordinary skill in the art, in light of this teaching, can generate additional embodiments and modifications without departing from the spirit of or exceeding the scope of the claimed invention. Accordingly, it is to be understood that the drawings and descriptions herein are proffered by way of example to facilitate comprehension of the invention and should not be construed to limit the scope thereof.

What is claimed is:

1. A collapsible frame assembly adapted to be disposed in an open configuration on a horizontal surface for holding a cover sheet to protect items resting on said horizontal surface, said frame assembly comprising:

a pair of elongated substantially rigid base members, said base members being adapted to rest on said horizontal surface; and a pair of substantially rigid support members each of which has two ends, each of said support members including means cooperably connected at a respective end thereof to a respective one of the said base members which permits each support member to rotate with respect to the base member to which it is connected, said support members also including means cooperably interconnecting the other end of each respective rigid support member to each other to permit rotational movement between said support members, whereby said frame is collapsed from the open configuration by rotating the support members in a manner which brings the support members and the base members adjacent one another to form a folded storage configuration and wherein the frame is opened from said folded storage configuration by rotating the support members in an opposite direction.

2. The collapsible frame assembly defined in claim 1, further comprising means on each of said base members for engaging an edge of said horizontal surface to prevent motion of the respective base member in a direction parallel to said horizontal surface and perpendicular to said edge.

3. The collapsible frame assembly defined in claim 1 wherein each of said support members is substantially in the form of an ogive.

4. The collapsible frame assembly defined in claim 1 wherein each of said base members is provided with a plurality of projections engageable with said horizontal surface for supporting said base members thereon.

5. The collapsible frame assembly defined in claim 1, further comprising means on at least one of said members for locking the frame assembly in said folded storage configuration.

6. The collapsible frame assembly defined in claim 1, including means wherein each support member and the respective base member connected thereto are rotatable relative to one another through a 90° angle.

7. The collapsible frame assembly defined in claim 6, including means wherein said support members are rotatable relative to one another through a 180° angle.

8. A collapsible frame assembly disposable on a horizontal table surface for holding a cover sheet to protect food on the table surface, said frame assembly comprising:

a pair of elongate substantially rigid base members;

a pair of substantially rigid support members;

first pivot means for rotatably connecting each of said support members at a first end thereof to a respective one of said base members;

second pivot means for swingably connecting said support members to one another at second ends thereof opposite the respective first ends, said base members defining a plane, each of said support members and the respective base member connected thereto by said first pivot means being rotatable relative to one another about a respective axis substantially perpendicular to said plane, said support members extending out from said plane and being relative to one another rotatable about an axis substantially perpendicular to said plane;

abutment means including a pair of flanges at opposite ends of each of said base members for engaging opposed parallel edges of the horizontal table surface to prevent motion of the respective base member in a direction substantially parallel to said horizontal table surface and perpendicular to said opposed parallel edges; and contact means including a pair of projections on each of said base members engageable with said horizontal table surface for supporting said base members on said horizontal table surface, said projections extending parallel to said plane.

9. A collapsible frame assembly disposable on a horizontal table surface for holding a cover sheet to protect food on the table surface, said frame assembly comprsisng:

a pair of elongate substantially rigid base members, said base members being engageable with the horizontal table surface;

a pair of substantially rigid support members;

first pivot means including a pair of first hinges for rotatably connecting each of said support members at a first end thereof to a respective one of said base members; and second pivot means including a second hinge for swingably connecting said support members to one another at second ends thereof opposite the respective first ends, said base members defining a plane, each of said support members and the respective base member connected thereto by said first pivot means including abutment means for limiting rotation of such support member and the respective base member relative to one another to a 90° angle about a respective axis substantially perpendicular to said plane, said support members extending out from said plane and including abutment means for limiting rotation of said support members relative to one another to a 180° angle about an axis substantially perpendicular to said plane.

10. A serving cart attachment for supporting a sheet for covering a set of dishes on a serving cart, said attachement comprising:

a pair of elongate base members each in the form of a shallow U having an elongate central portion with a longitudinal axis and a pair of legs at opposite ends of the central portion, said legs extending in a common direction from said central portion parallel to one another, each of said elongate base members being provided with a pair of support pins spaced from one another in a direction parallel to said longitudinal axis and disposed on the same side of said central portion as said legs, said central portion and said legs having a common width, said central portion having a pair of longitudinal edges extending parallel to said longitudinal axis and spaced from one another by said common width, said pins being spaced from each of said longitudinal edges;

a pair of arcuate support members each substantially in the form of an ogive and each having a first planar side and a second planar side parallel to and opposed to one another, each of said support members further having a first end and a second end opposed to one another;

a pair of first hinges each connecting one of said support members on said first side and at said first end to a respective one of said base members approximately at a midway point along the respective central portion to enable rotation between the respective support member and the respective base member about a pivot axis oriented substantially perpendicularly to the longitudinal axis of the respective central portion, said support pins being spaced from and disposed on opposite sides of the respective midway point;

first abutment means on said support members and base members for limiting relative rotation between each support member and the respective base member to a 90° angle;

a second hinge connecting the support members to one another at the second ends and on the second sides to enable a rotation between said support members about a rotation axis substantially parallel to said pivot axis; and second abutment means on said support members for limiting relative rotation between said support members to a 180° angle.

* * * * *